US006823702B2

(12) United States Patent
Häggstrom

(10) Patent No.: US 6,823,702 B2
(45) Date of Patent: Nov. 30, 2004

(54) CYLINDER LOCK-KEY COMBINATION

(75) Inventor: Ake Häggstrom, Lycksele (SE)

(73) Assignee: Assa AB, Eskilstuna (SE)

( * ) Notice: Subject to any disclaimer, the term of this patent is extended or adjusted under 35 U.S.C. 154(b) by 0 days.

(21) Appl. No.: 10/481,476

(22) PCT Filed: Jun. 25, 2002

(86) PCT No.: PCT/SE02/01247

§ 371 (c)(1),
(2), (4) Date: Dec. 18, 2003

(87) PCT Pub. No.: WO03/001011

PCT Pub. Date: Jan. 3, 2003

(65) Prior Publication Data

US 2004/0172995 A1 Sep. 9, 2004

(30) Foreign Application Priority Data

Jun. 26, 2001 (SE) ..... 0102262

(51) Int. Cl.[7] ..... E05B 27/06

(52) U.S. Cl. ..... 70/358; 70/409; 70/493; 70/495

(58) Field of Search ..... 70/358, 409, 493–495, 70/406, DIG. 37, DIG. 38

(56) References Cited

U.S. PATENT DOCUMENTS

| | | | | | |
|---|---|---|---|---|---|
| 2,111,098 | A | | 3/1938 | Segal | 70/493 |
| 3,348,392 | A | | 10/1967 | Schreiber | 70/358 |
| 3,349,588 | A | | 10/1967 | Hines | 70/493 |
| 4,083,210 | A | * | 4/1978 | Bergin | 70/490 |
| 4,434,636 | A | * | 3/1984 | Prunbauer | 70/358 |
| 4,478,061 | A | | 10/1984 | Preddey | 70/358 |
| 4,603,565 | A | * | 8/1986 | Strassmeir | 70/358 |
| 5,138,856 | A | * | 8/1992 | Chyun | 70/493 |
| 5,222,383 | A | * | 6/1993 | Fann et al. | 70/358 |
| 5,582,050 | A | * | 12/1996 | Haggstrom | 70/495 |
| 5,682,779 | A | * | 11/1997 | Dolev | 70/494 |
| 5,784,910 | A | * | 7/1998 | Eizen et al. | 70/395 |
| 5,894,750 | A | * | 4/1999 | Liaw | 70/359 |
| 6,076,386 | A | | 6/2000 | Etchells et al. | 70/369 |
| 6,490,898 | B1 | * | 12/2002 | Mottura | 70/495 |
| 6,615,628 | B2 | * | 9/2003 | Lou | 70/409 |

FOREIGN PATENT DOCUMENTS

| | | |
|---|---|---|
| AT | 368232 C | 9/1982 |
| DE | 3014183 A1 | 6/1981 |
| FR | 2551794 A1 | 3/1985 |
| WO | WO 0053870 A1 | 9/2000 |

* cited by examiner

*Primary Examiner*—Llyod A. Gall
(74) *Attorney, Agent, or Firm*—Sughrue Mion, PLLC

(57) ABSTRACT

A cylinder lock-key combination including a cylinder housing, a key and a plug which has a circular-cylindrical barrel surface and which is rotatable in an opening in the housing. The barrel surface of the housing includes a key recess whose width exceeds its depth, and a plurality of code pin channels are preferably disposed in several rows. Code pin tumblers present in the code pin channels co-act with one or more blocking elements, such as pins or side bars, disposed in channels intended to this end. The blocking elements block rotation of the plug when one side surface of an inserted key presents wrong code surfaces. There is provided in this way a compact lock construction, which also enables the use of many code pins.

20 Claims, 7 Drawing Sheets

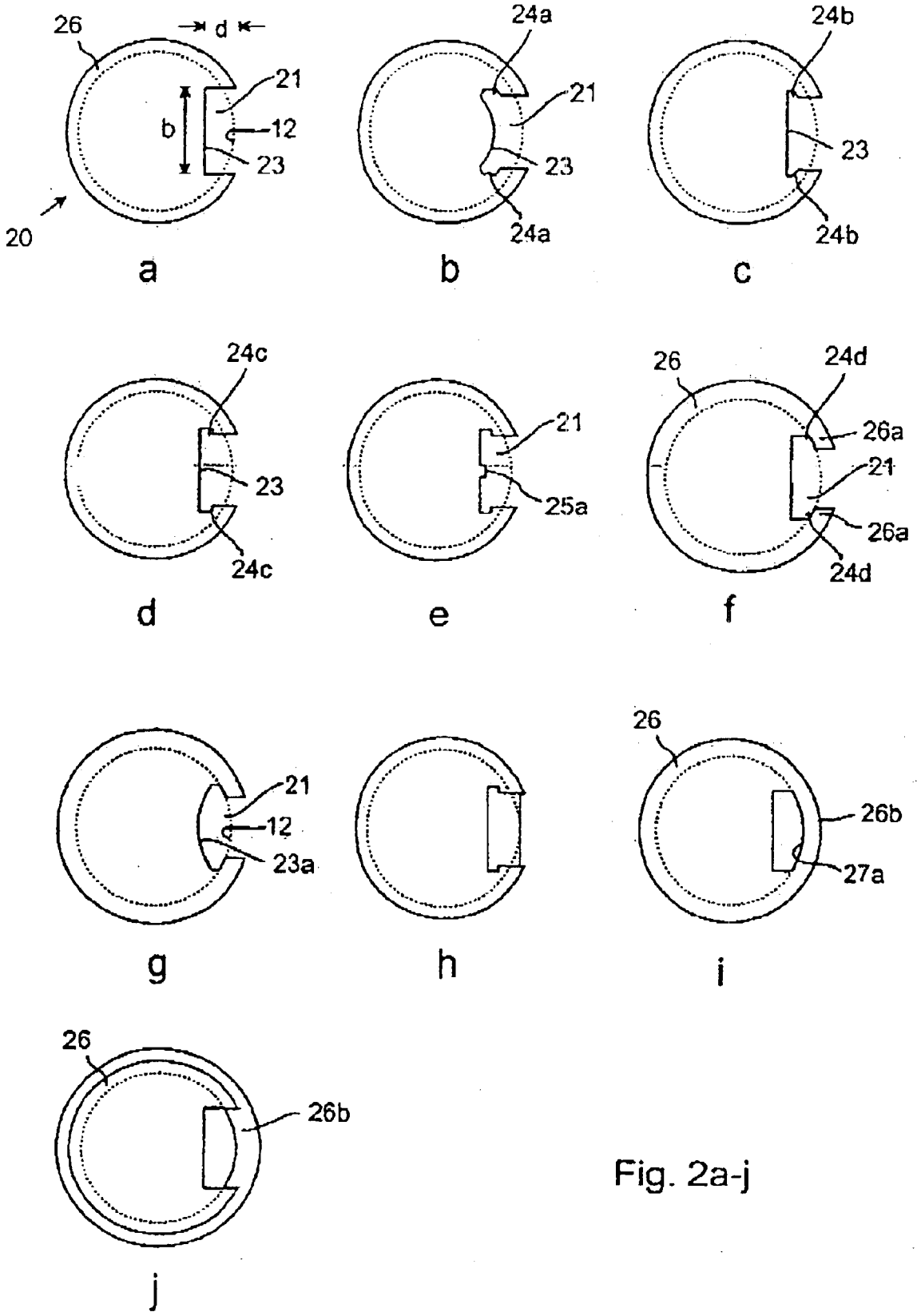
Fig. 2a-j

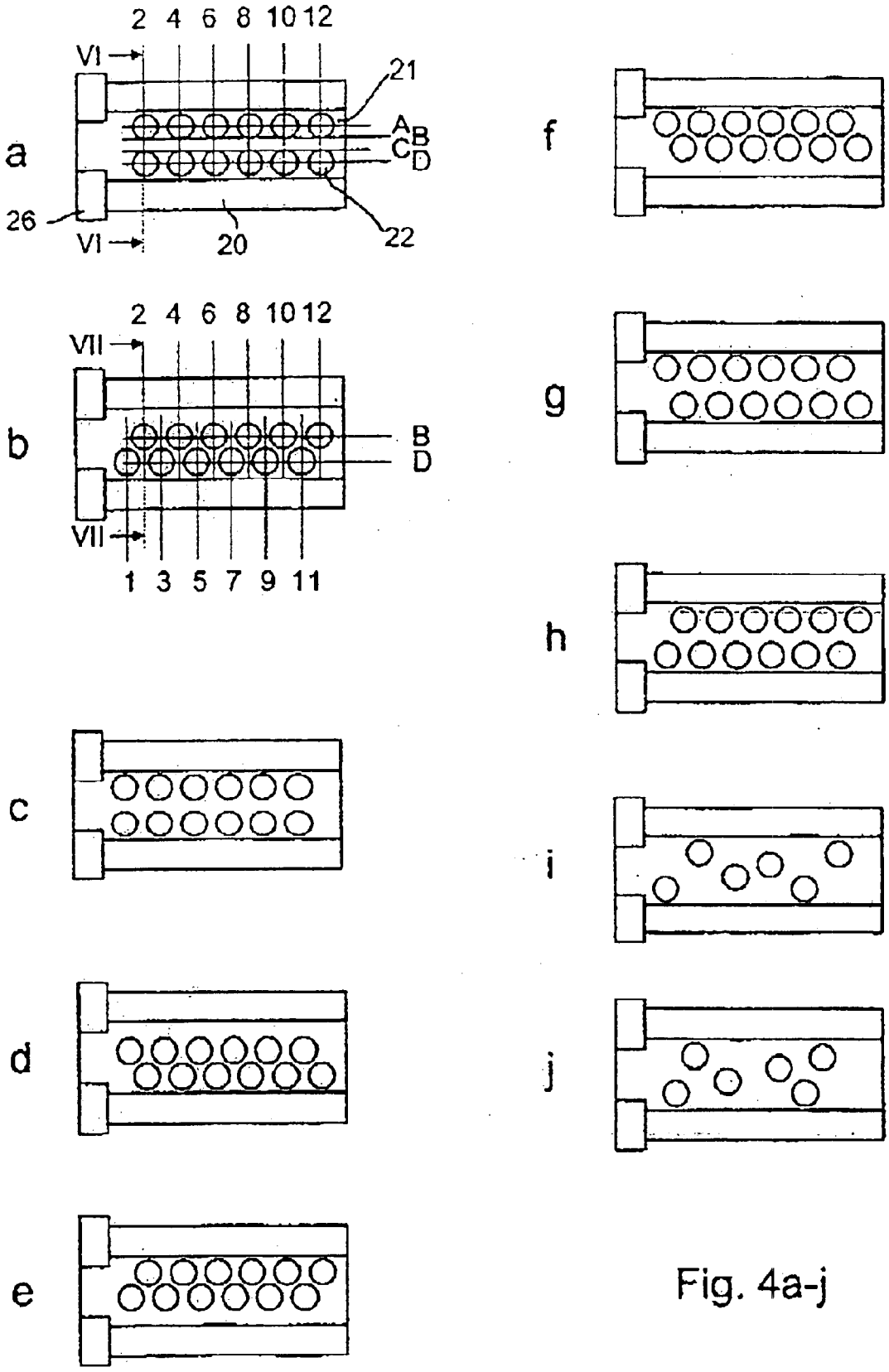
Fig. 4a-j

CYLINDER LOCK-KEY COMBINATION

FIELD OF INVENTION

The present invention relates generally to a cylinder lock and then particularly to a cylinder lock-key combination with an eccentrically placed key.

DESCRIPTION OF THE BACKGROUND ART

Ever greater demands are placed on present day lock devices, thereamong cylinder locks, with regard to safety and also with regard to compact lock designs. One way of enhancing safety is to increase the number of code surfaces, which in the case of a pin tumbler cylinder implies an increase in the number of pins. However, an increase of the nature involved makes it difficult to provide a compact lock construction.

U.S. patent document U.S. Pat. No. 3,348,392 describes a method of systematisation that requires a large number of code surfaces. This system is based on leaving a few code pin channels empty, instead of utilising all available channels. This results in a systematisation in which the use of intermediate pin tumblers is avoided. In order to achieve a large number of code surfaces, the document proposes the use of a key that has a circular cross-section in the key bit, which is placed centrally in an opening in the cylinder plug intended to this end. One problem with this solution resides in the difficulty in producing a compact lock of small diameter.

The Austran Patent Specification 368 235 describes a cylinder lock that includes code-guided, enable a block device, such as a side bar, to leave an opening provided in the cylinder housing, in a correct code position. The key is comprised of a relatively thick material and code surfaces are disposed at the junction between the side surface and the upper surface of the key bit. Moreover, the waisted pins extend obliquely in the lock plug. The illustrated solution is therefore space demanding and, consequently, unsuitable for small locks.

SUMMARY OF THE INVENTION

One object of the present invention is to provide a highly secure cylinder lock-key combination which, at the same time, enables the lock cylinder or plug to be given a compact construction.

The invention is based on the realisation that a secure and, at the same time, a compact cylinder lock construction can be achieved by a combination of an eccentrically placed key and code pin channels disposed in the bottom of a recess in the barrel surface of the cylinder plug.

Accordingly, an inventive cylinder lock-key combination has the features defined in the accompanying claim 1.

Other preferred embodiments are apparent from the accompanying dependent claims.

An inventive cylinder lock-key combination provides a high degree of security as a result of the large number of code pins, which also makes possible the inventive systematisation principle. Because the key opening is placed on the periphery of the cylinder plug and the pin tumblers co-act with code surfaces disposed on the side surface of the key bit, the large number of cylinder pins and at the same time, the cylinder plug can be made short and given a small diameter.

BRIEF DESCRIPTION OF THE DRAWINGS

The invention will now be described in more detail by way of example and with reference to the accompanying drawings, in which

FIGS. 2*a–j* are respective end views of various embodiments of an inventive cylinder lock plug;

FIGS. 4*a–j* are respective side views of various embodiments of an inventive cylinder lock plug, which also show different possible pin channel positions;

DESCRIPTION OF EMBODIMENTS

Figure 1:
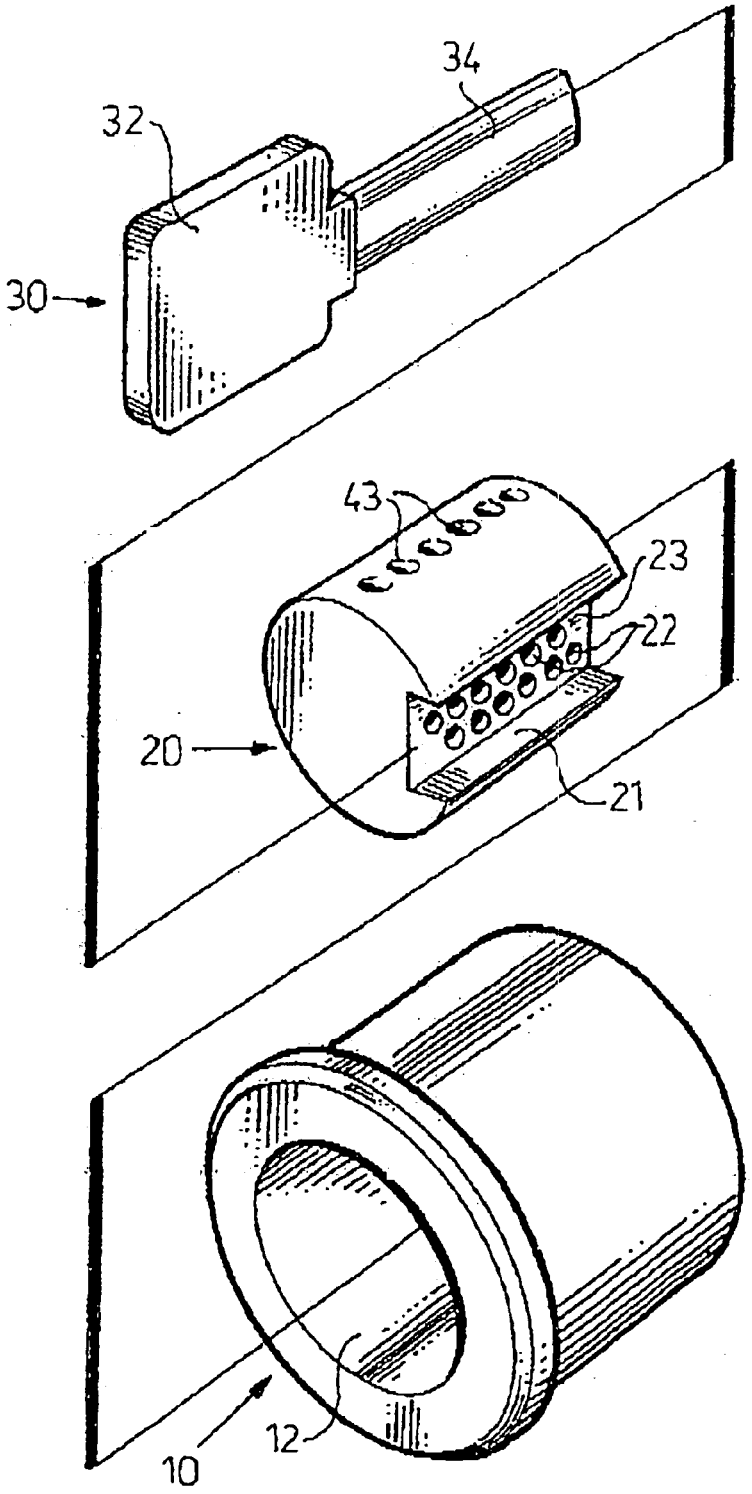
FIG. 1 is a principle sketch in perspective of a cylinder lock-key combination in accordance with the invention.

Preferred embodiments of a cylinder lock-key combination according to the present invention will now be described, firstly with reference to FIG. 1. This figure is an outline diagram of a cylinder lock that includes a cylinder housing 10 having a cylindrical opening 12 and accommodating a plug or cylinder 20 adapted for rotation in the housing 10. The barrel surface of the plug includes a recess 21 that is intended to receive a key 30. The plug also includes a number of code pin channels 22 which open into the bottom surface 23 of the recess 21 and of which at least some accommodate a respective code pin tumbler (not shown), as described in more detail below. Each code pin channel 22 communicates with a channel 43 which is perpendicular thereto and which opens into the barrel surface of the plug, as apparent from FIG. 1. A blocking pin (not shown in FIG. 1) which functions as a blocking element in the plug is placed in at least some of said channels 43.

The key includes a key grip 32 to which there is connected a key bit 34 which has roughly a D-shaped cross-section and therewith adapted for accommodation in the recess 21. The side surface of the key bit that faces away from the viewer includes code grooves which are adapted to co-act with the code pins accommodated in the pin channels 22.

The configuration of the recess 21 will be described hereinafter with reference to FIGS. 2*a–j*, which show different possible configurations by way of end views of the cylinder plug 20.

FIG. 2*a* shows the basic form or configuration, which is also shown in FIG. 1. Thus, the plug 20 includes a generally cylindrical section that has a collar 26 which extends beyond the radius of the opening 12 in the cylinder housing. This radius is shown by a dotted line in FIG. 2. The recess 21 shown in FIG. 2*a* is thus adapted for a key bit of essentially D-shaped cross-section. The planar side surface of the key bit lies against the bottom 23 of the recess 21, while the convex or arc-shaped side surface faces towards the wall of the opening 12.

The ratio between the width b and the depth d of a recess 21 is greater than 1, preferably greater than 2 and still more preferably greater than 3. The greater the value of this ratio, the less space required by a key used with the lock, therewith allowing a smaller plug diameter to be used.

When locking or unlocking the lock, the plug 20 is turned by means of the key inserted into the recess 21 such as to cause the key to turn in an arcuate path.

FIG. 2*b* illustrates a variant in which the recess 21 has generally the same shape as the recess shown in FIG. 2*a*. However, the recess of FIG. 2*b* includes two grooves or slots 24*a* that are intended to receive corresponding projections on the key when inserted into the recess. This ensures improved radial fixation of the key, in other words the key need not rest against the wall of the opening 12 as distinct from the first example. This also avoids unnecessary friction between key and opening wall. It will be noted that the recess 21 shown in FIG. 2*b* has a convex bottom surface 23, wherewith the key bit is essentially of uniform thickness.

FIGS. 2*c* and 2*d* illustrate respectively variants of the recess 21 shown in FIG. 2*b*, wherein both of said recesses include a respective groove 24*b* and 24*c* for radial fixation of the key in the recess 21. The bottom surface 23 of the recess is, however, flat and thus corresponds to the bottom surface of the recess shown in FIG. 2*a*.

FIG. 2*e* shows a plug 20 which has a recess 21 whose bottom surface includes a longitudinally extending projection 25*a* which is intended to co-act with a corresponding groove in the flat surface of a coded key. This results in coding of the key profile, such that an inserted key must have a correct profile, i.e. a correct cross-sectional shape, in addition to having the correct code surface. It will be seen in this regard that the placement of the projection 25*a* can be varied in comparison with the illustrated placement, or more than one longitudinally extending projection can be provided. The shape of the bottom surface may, of course, be varied in some other way in obtaining the desired profile coding.

FIG. 2*f* shows a plug in which the collar 26 extends beyond the edges of the recess 21, so as to obtain radial fixation of an inserted key through the medium of two lips 26*a*. In this case, the key is fixated in the grooves 24*d* thus defined.

FIG. 2*g* shows a recess 21 that has a concave bottom surface 23*a* whose curvature corresponds to the curvature of the wall defining the opening 12. This results in an opening for a symmetrical key that can be inserted in two ways, which is typical in respect of car locks, for instance. This also enables the key to be provided with a code surface on both of the side surfaces of the key bit, which can facilitate use of the key.

FIG. 2*h* shows a plug that is identical to the plug shown in FIG. 2*d*, although with the exception that the cylinder housing includes radial grooves, as described in Swedish Patent Application SE-9704610-6, this application being included in this document by virtue of this reference thereto. Thus, it is necessary to provide the outwardly facing surface of the key bit with a corresponding groove, since the radial groove in the cylinder housing will otherwise prevent the plug from turning.

The plug shown in FIG. 2*i* has a collar 26 which includes a part 26*b* that surrounds the 27*a*. The hole 27*a* may be provided by drilling and drifting from the end surface of the plug. This prevents skewing of a key inserted in the hole 27*a*.

The plug shown in FIG. 2*j* includes a fully surrounding collar that is formed as a separate part 26*b* that can be mounted onto the remainder of the core 21 during manufacture. This solution will be described below with reference to FIGS. 3*a–c*. The solution ensures radial fixation of an inserted key in correspondence with the solution shown in FIG. 2*i*, although the solution according to FIG. 2*j* has benefits from a manufacturing aspect.

Figure 3A:
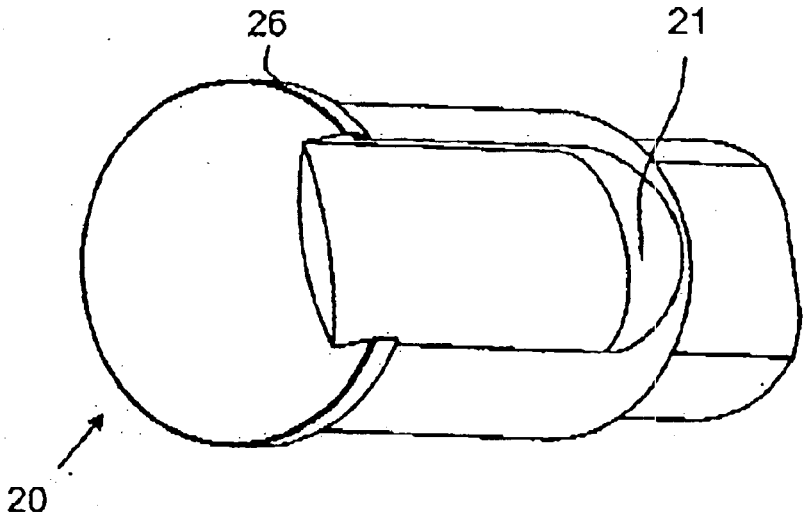
FIGS. 3*a–c* are respective views of a cylinder lock plug, an anchor ring, and the combination of the plug ring.
Figure 3B:
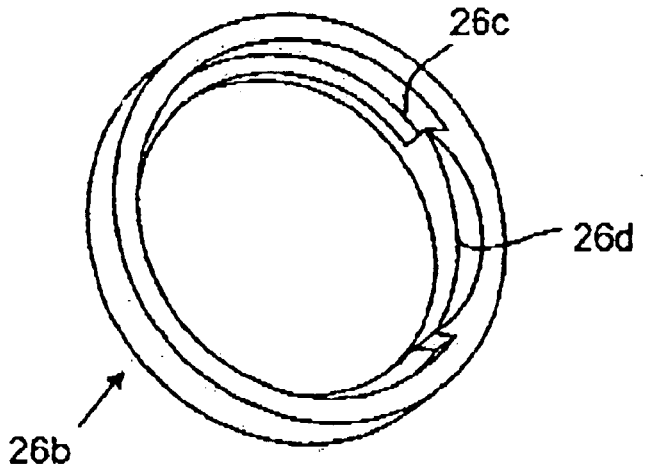

FIG. 3*a* is a perspective view of the core 20 including the recess 21 and provided with a collar 26, FIG. 3*b* shows the additional collar part 26*b* that consists of a ring which includes, in addition to a sector 26*d*, an internal step or ledge 26*c* that corresponds to the extension of the recess 21. The ring 26*b* is preferably made of a hard material such as sintered metal, wherewith the ring also functions as a guard against manipulating the lock by drilling.

Figure 3C:
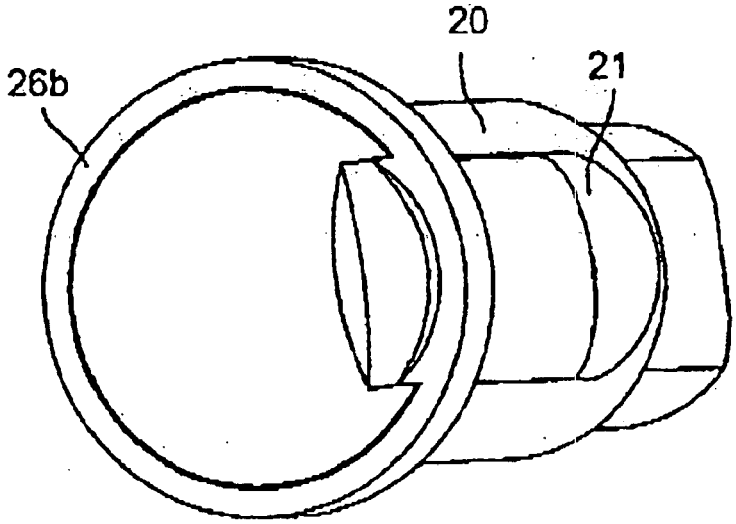

A FIG. 3*c* shows the plug 20 subsequent to having fitted the collar ring 26*b* FIG. 3*b* from the rear, until the ring is in abutment with the collar 26 formed integrally with the plug. The sector 26*d* of the ring 26*b* that engages in a part of the recess 21 prevents relative rotation between the plug 20 and the ring 26*b*. From the aspect of manufacture, this provides a satisfactory method of radially fixating a key inserted in the recess 21. Because the ring 26*b* fully surrounds the collar. i.e. lacks the provision of a slot in distinction to conventional lock constructions, the solution also provides a satisfactory bearing means between the plug and the cylinder housing.

If additional fixation of an inserted key is desired, the inner part of the recess 21, i.e. that part of the recess at which the tip of the key is located, may be provided with a groove that fixates the tip of the key bit.

The solution shown in FIGS. 3*a–c* reduces friction between key and cylinder housing while preventing skewing of the key at the same time.

The function and the placement of the code in channels shown in FIG. 1 are described below with reference to FIGS. 4*a–i*, in which side views of a plug according to the invention show examples of the positioning of code pins. FIG. 4*a* shows how two rows of six code pin channels 22 are disposed in the bottom surface of the recess and at right angles thereto. Four row heights have been referenced A, B, C and D in the figure, wherewith the rows in FIG. 4*a* are shown to lie at heights A and D. Thus, there are now code pin channels at heights B and C. The code pin channels in each row lie at mutually different positions in the longitudinal direction referenced 2, 4, 6, 8, 10 and 12 in the figure, with 4 mutually constant distance between adjacent pin channels in the axial direction. The code pin channels in the two rows A, D have mutually the same positions axially, in other words the six channels in the upper row A lie exactly above the six channels in the lower row D. This will also be apparent from FIG. 6*a*, which shows a cross-sectional view through the plug of FIG. 4*a* taken on the line VI—VI, as will be described in more detail below.

Figure 7A:
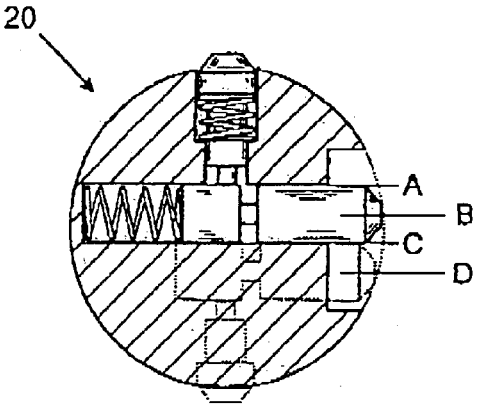
FIGS. 7*a* and 7*b* are respective sectional views of a second embodiment of an inventive cylinder plug.
Figure 7B:
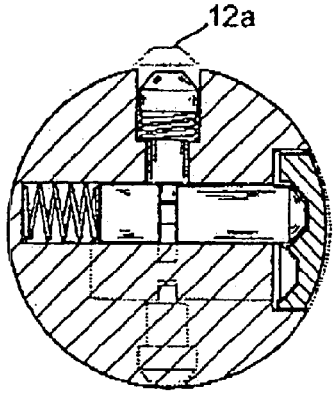

FIG. 4*b* shows a variant in which the rows B and D are used as pin channels instead. Because the relative distance of these rows is smaller than in the case in FIG. 4*a* it is not possible to arrange the code pin channels in the different rows immediately above each other. This is clearly evident from FIG. 4*b*, in which the six code pin channels in the two rows are mutually displaced in the longitudinal direction of the plug 20. Thus, the channels of the upper row B have the positions 2, 4, 6, 8, 10 and 12, whereas the channels of the lower row D have the positions 1, 3, 5, 7, 9 and 11. FIGS. 7*a* and 7*b* are cross-sectional views of the plug shown in FIG. 4*b* taken on the line VII—VII. Pins in an axial position other than "2" are shown in dotted lines in the cross-sectional views.

Thus, the illustrated example includes twelve different axial positions 1–12 and four rows A–D, wherewith a total of 48 different positions is possible for each pin channel. This exceeds the possibilities achievable with conventional lock constructions and, among other things, makes possible the type of systematisation described in the earlier mentioned patent publication U.S. Pat. No. 3,348,392, which is included in this present document by virtue of the reference thereto. It will be understood, however, that not all 48 positions can be occupied by pin channels at one and the same time, since mutually adjacent channels would then overlap each other. For example, channels in the positions A1 and A2 would mutually overlap; as would also channels in positions A1 and B1.

FIGS. 4*c–h* illustrate different variants of the basic configurations shown in FIGS. 4*a* and 4*b*, these variants using other rows and/or axial positions. This reflects the flexibility of the inventive cylinder lock plug with regard to its design.

In principle, positioning of the code pin channels in the plug shown in FIG. 4*i* differs from the aforedescribed solutions. In this case, all four rows are used instead of only two. This solution is suitable for concurrent coding of both key and cylinder plug. Coding is preferably achieved with a computer program intended for this purpose. This also enables the code pin channels in the different lock cylinders in one and the same lock system to be placed in different positions, in other words each plug in a lock system is unique. This enables greater security to be achieved while retaining flexibility.

The solution illustrated in FIG. 4*i* is also suitable for use with a coded side bar, as will be explained below with reference to FIGS. 10*a* and 10*b*.

Because the plug shown in FIG. 4*i* is coded on delivery and because it is elected to drill solely in those positions that shall be used, there is obtained a greater degree of freedom with regard to possible positions. This means that the user is not restricted to the 48 positions described above and that it is possible to include far more than 12 positions per row, and also more than four rows. One example of this is shown in FIG. 4*j*, where the code positions have been slightly offset with respect to the code positions shown in FIG. 4*i*. In this regard, it is fully possible to include 100 different axial positions and ten rows, which gives 1000 different code positions.

As in the case of the example illustrated in FIG. 4*i* working of block elements, plugs and keys is preferably carried out at one and the same time.

Figure 5A:
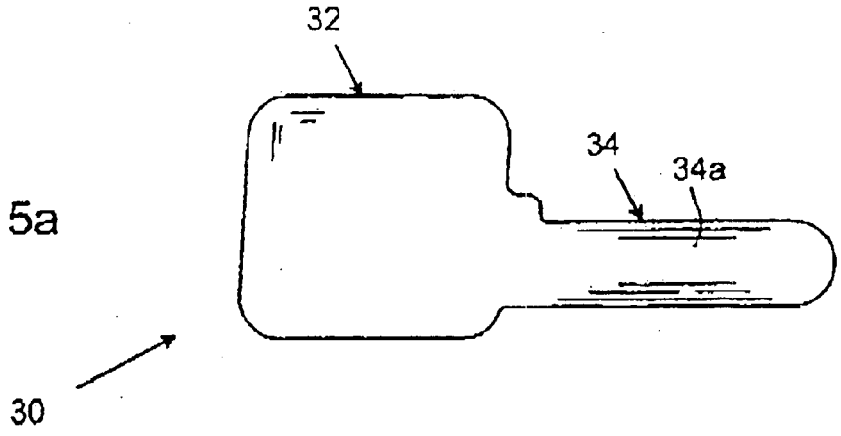
FIGS. 5*a–f* are respective views of a key according to the invention.
Figure 5B:
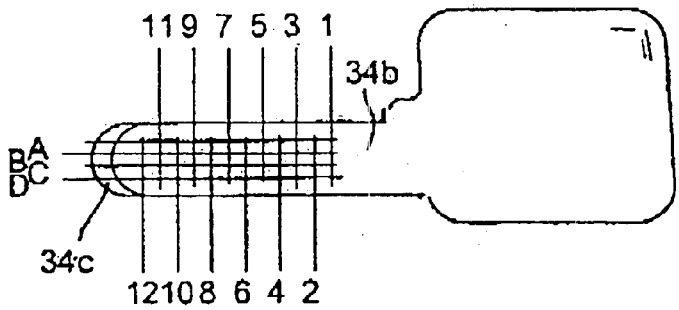

FIGS. 5*a–f* are respective illustrations of a key 30 intended for use with the inventive lock cylinder. The key includes a gripping portion 32 and a key bit portion 34, as in conventional designs. FIG. 5*a* shows that side 34*a* of the key bit portion which faces away from the pin channels 22 and lies proximal to the wall of the opening 12, i.e. the key bit side that lacks code grooves, whereas, FIG. 5*b* shows that side 34*b* of the key bit portion which faces towards the pin channels 22. Thus, FIG. 5*b* also shows points that correspond to possible positions of the pin channels 22, said positions being referenced 1–12 and A–D. As evident from FIG. 5*b*, the tip of the key bit portion 34 is bevelled in a manner described in more detail-below.

Figure 5C:
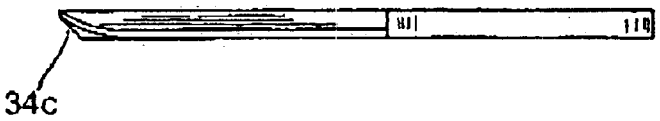
Figure 5D:
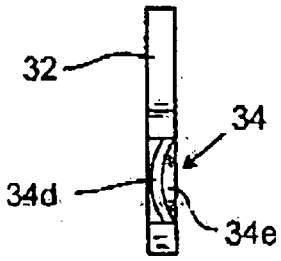

FIG. 5*c* illustrates the key 30 from above and shows the shape of the tip 34*c* more clearly. The tip 34*c* includes a planar front portion 34*d*. This portion is also shown in FIG. 5*d*, which is a front view of the key. This planar portion is sufficiently narrow not to prevent lifting of the code pins 41, for instance 0.5 mm, while being sufficiently broad to prevent the key tip from being felt unpleasantly sharp by a user. An excessively pointed tip 34*c* will also carry the risk of the key damaging the user's clothing, etc. The view of FIG. 5*d* also shows the general D-shaped profile of the key bit portion 34, this profile co-acting with the recess 21 shown in FIG. 2*a*.

The design of the front end tip portion the key 30 is of the utmost importance. Accordingly, the tip portion 34*c* of the key is given a compensated radius form so as to enable the code pins in the different rows to be lifted; see FIG. 5*d*. The key tip is thus rounded and includes a generally planar, bevelled or chamfered portion 34*e*, whereas the width of the font end surface 34*d* is generally constant.

Figure 5E:
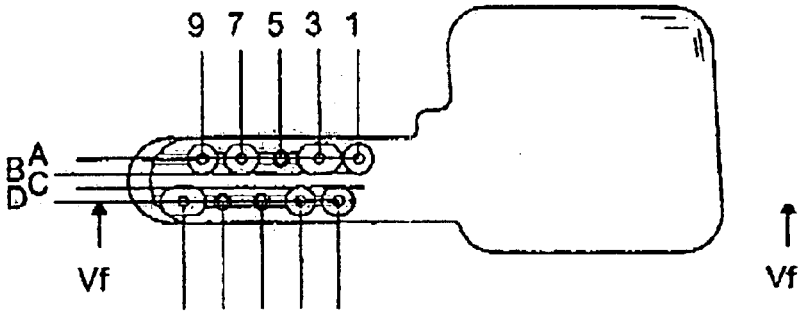
Figure 5F:
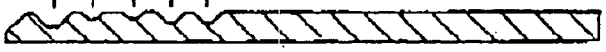

FIG. 5*e* shows the coded side of the key 30 that includes the indentations or depressions shown by way of example. These indentations are illustrated as circles of varying diameters. Different code heights are obtained, depending on the depths of respective indentations, i.e. the thickness of the residual material from the other side of the key is determined by the depth of a respective indentation. The preferred embodiment uses four predetermined code heights, of which three are used in row D in the FIG. 5*e* example. For instance, a first, greatest height is found in positions D6 and D8, a second, lower height is found in the positions D2 and D4, and a third, lowest height is found in the position D10. "The height" is reflected in the depth of respective code indentations in the key. This is clearly evident from FIG. 5*f* which is a sectioned view along the code row D in the key shown in FIG. 5*e*.

The construction of the key code makes the key suitable for manufacture by means of a simple NC miller that includes an end cutter. This is mainly because the side surfaces of the code indentations are inclined at an angle of preferably 45 degrees; see FIG. 5*f*.

Figure 6A:
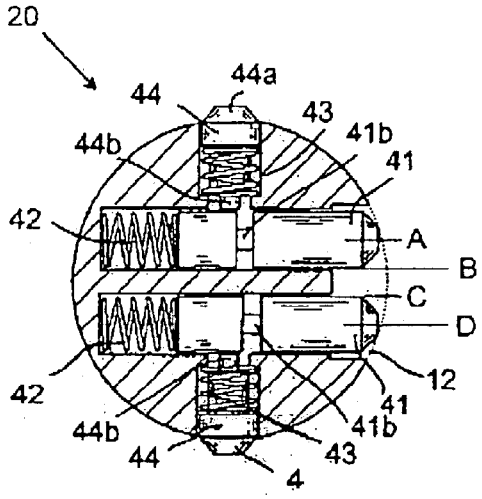
FIGS. 6*a* and 6*b* are respective sectional views of a first embodiment of an inventive cylinder plug.

The pin function principle will be explained below with reference to FIGS. 6*a* and 6*b*. FIG. 6*a* is a cross-sectional view of the plug 20 shown in FIG. 4*a* in register (height) with the code pin position 2 when no key has been inserted into the recess 21. Thus, there is shown two code pin channels of which one is on a level with row A and one is on a level with row D. Movably arranged in each channel is a code pin 41, which is spring biased outwardly by means of a spring 42. Thus, in the FIG. 6*a* illustration, the tip of the code pin rests against the wall of the opening 12.

Extending at right angles to each pin channel 22 is a channel 43 in which a blocking element 44 in the form of a blocking pin is movably arranged. The blocking pin 44 includes a tip 44*a* intended for engagement in a depression or indentation 12*a* in the wall of the opening 12; see FIG. 6*b*. The blocking pin 44 includes a peg 44*b* on the opposite end to the tip 44*a*, said peg being intended for engagement in a waisted portion 41*b* of the code pin 41.

FIG. 6*a* shows the blocking pins 44 in a blocking position, i.e. in positions in which they prevent rotation of the plug 20 relative to the surrounding housing as a result of their engagement in the indentations or depressions 12*a*. Because the waisted portions of respective code pin tumblers 41 are not in alignment with the pegs 44*b* of respective pins 44, these pins are prevented from leaving their blocking position. One advantage achieved with the use of blocking pins is that axial movement of the plug 20 relative to the housing 10 is also blocked, thereby providing a more stable fastening of the plug.

Figure 6B:
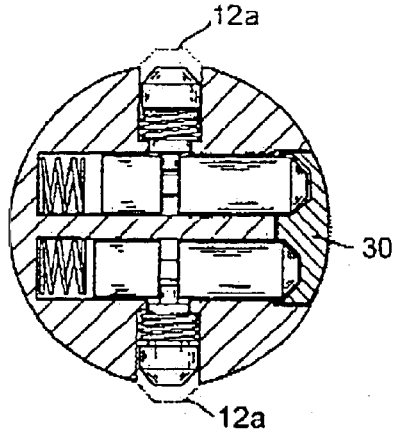

FIG. 6*b* shows the plug in which a correct key 30 has been inserted into the recess 21. As before mentioned, insertion of the key into the recess is made possible partly due to the front end of the key having the form of a tip 34*c*, see FIG. 5*c*, and partly because the tips of the code pins have angled side surfaces. The code pins 41 are thereby urged or pressed into their respective channels as the key 30 is moved into the recess 21.

The extent to which the code pin 41 is pressed into its channel is determined by the code height of the key code position concerned. A correct key includes indentations which press-in the code pins to an extent such as to bring the waisted portions 41*b* in line with the pegs 44*b* on the blocking pins, therewith preventing said pins tom taking a non-blocking position shown in FIG. 6*b*. The extent to which the code pin 41 shall be pressed in is determined by the position of each waisted portion; four different positions or placements of the waisted portion is obtained with four different code heights.

The sectional views of FIGS. 7*a* and 7*b* correspond to a large extent to the sectional views shown in FIGS. 6*a* and 6*b*, although taken on the line VII—VII in FIG. 4*b*. Thus, only one code pin/blocking pin lies in the section plane, this pin being the code pin in row B in the illustrated case. Code pins in row D are shown in dotted lines in the figure.

Figure 8A:
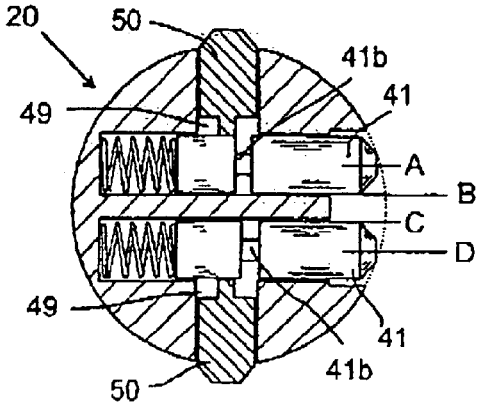
FIGS. 8*a* and 8*b* are respective sectional views of a third embodiment of an inventive cylinder plug.
Figure 8B:
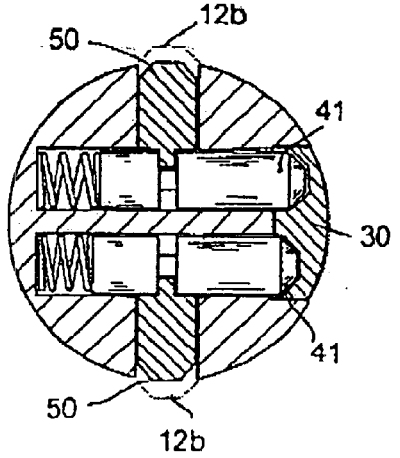
Figure 9A:
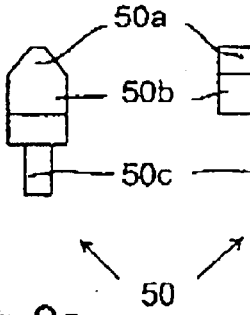
FIGS. 9*a* and 9*b* are respectively an end view and a side view of a side bar included in the cylinder plug shown in FIGS. 8*a, b;*
Figure 9B:
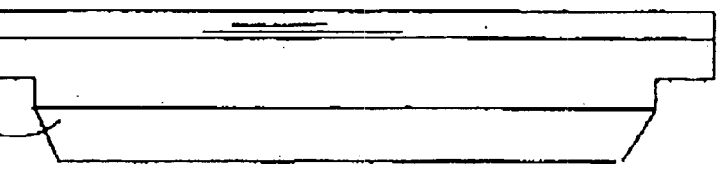

FIGS. 8*a* and 8*b* also correspond to the sectioned views of FIGS. 6*a* and 6*b*. However, in the case of the illustrated embodiment the blocking pins 44 have been replaced by two side bars 50 disposed in a longitudinally extending channel 49 in the barrel surface of the cylinder plug 20. An example of a side bar 50 is shown in FIGS. 9*a* and 9*b*. The side bar is elongated with a length that corresponds essentially to the distance between the axial outer positions of the code pin holes 22, i.e. the positions 1 and 12; see FIGS. 4*a*, 4*b* for instance. The side bar also includes an upper bevelled portion 50*a* for engagement in a corresponding axial groove 12*b* in the opening 12; see FIG. 8*b*. The side bar also includes a body 50*b* whose width slightly exceeds the width of the longitudinally extending grooves 49 in the plug 20, thereby allowing radial movement therein. Finally, the side bar includes a narrower lower portion 50*c* whose width is slightly smaller than the width of the waisted portion 41*b* of the code pin 41.

As will be evident from FIGS. 8*a* and 8*b*, the upper side bar acts against code pins in the code row A, while a lower code bar acts against code pins in the code row D. Thus, when all pins in the code row A are in their correct positions, rotational blocking functions to allow the upper side bar 50 to "sink down" to the position shown in FIG. 8*b*, whereas when all pins in the code row D have taken their correct positions, the lower side bar is allowed to sink down to the release position.

Figure 10A:
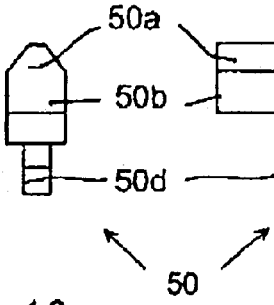
FIGS. 10*a* and 10*b* are respectively an end view and a side view of a coded side bar adapted for the cylinder lock plug shown in FIG. 4*i*.
Figure 10B:
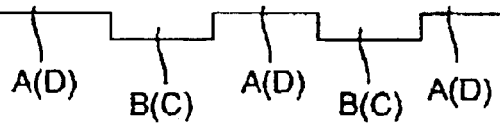

When using the coding positions according to the principle shown in FIGS. 4*i*, i.e. when using more than two code rows A–D, there can be used a side bar constructed in accordance with FIGS. 10*a* and 10*b*. This side bar has portions 50*a* and 50*b* that correspond to those shown in FIGS. 9*a* and 10*b*. However, the lower part 50*d* includes varying heights, such that certain parts are arranged to act against code pins placed on the code row A (or D), while other parts are arranged to work against code pins placed on the code row B (or C). These different parts have been marked in the figure. There is thus provided a coded side bar that is different for different code combinations.

Ah inventive cylinder lock-key combination affords many advantages. The combination of a key recess in the barrel surface of the plug and communicating pins enables the plug material to be utilised almost to an optimum. This also enables the use of a plug of small diameter—13 mm is a plug diameter that functions splendidly with two rows of code pins, although a diameter as small as 9 mm is also possible.

As will be evident from the figures, the blocking elements—pins or sidebars—are placed in the centre of the plug. This is an advantage from the aspect of mechanical strength.

Moreover, a key code that is let into one side surface of the key bit provides a key that is friendly both to skin and clothing. The possibility of a large number of code positions makes the described cylinder lock suitable for use with the principle of systematisation described in the mentioned U.S. Publication 3,348,392, in which only certain code positions are active.

Figure 11A:
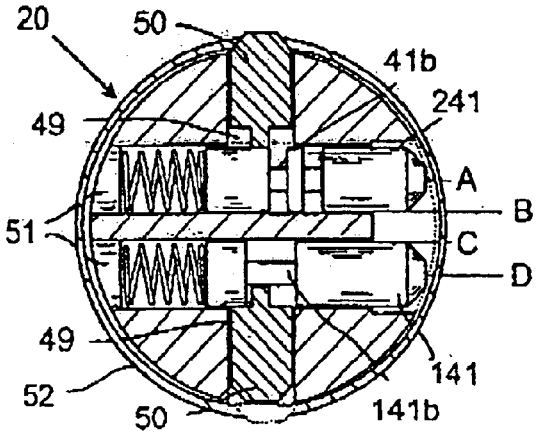
FIGS. 11*a* and 11*b* are sectional views similar to those in FIGS. 6*a* and 6*b*, but showing alternative embodiments of code pins and false code pins inclusive.
Figure 11B:
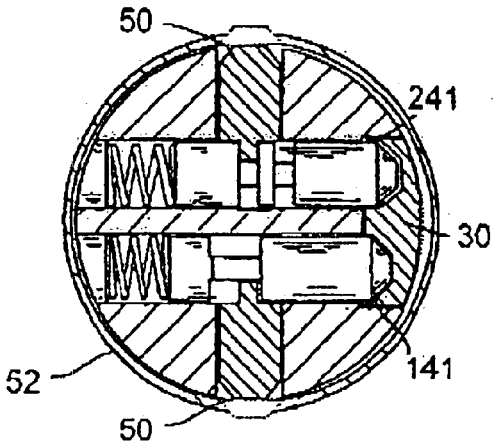

In order to avoid the risk of an unauthorised person attempting to manipulate the lock from detecting which code pin channels have been used, the non-active channels may conveniently be filled with false code pins that have no coding function and which will now be described with reference to FIGS. 11*a* and 11*b*. The false pins preferably consist or a conventional code pin 41 that includes a waisted portion whose length permits the blocking element to move to a release position regardless of the code presented by an inserted key for the position concerned. In FIGS. 11*a* and 11*b*, the lower code pin 141 in row D is one such false pin that includes an extended waisted portion 141*b*. It will also be evident from the figures that the lower side bar is able to move from its blocking position shown in FIG. 11*a* to the release position shown in FIG. 11*b* regardless of the position of the code pin 141.

The use of false code pins can thus be seen as an alternative to using empty code pin channels or to solely drilling code pin channels in those positions that are used. The number of false code pins used resides in a balance between economy and security. For example, it can be elected to fill only some of the unused code pin channels with false code pins, or to fill all of said code pin channels 22 with either a valid code pin or with a false pin.

The valid, or genuine, code pins 41 have been shown with only one waisted portion. It will be understood, however, that a code pin can be provided with more than one waisted portion. An example in this respect is shown in the form of the upper code pin 241 evident from FIGS. 11*a* and 11*b*. This adds a further dimension to the possibilities of systematisation.

These further waisted portions may also consist of so-called false waists, as described in Swedish Patent Application SE 9103779-6, for example.

It is also possible to provide a code pin with one single although higher waisted portion that is consequently non-blocking to the blocking element in several mutually adjacent code positions.

In the embodiments described above with reference to FIGS. 6*a*–8*b*, the code pin channels have been shown to include a bottom with which a spring 42 abuts. This implies that the channels have been produced by drilling or in some similar manner from the recess 21. FIGS. 11*a* and 11*b* show an alternative in this regard, in which the code pin channels are through-penetrating, i.e. open into the barrel surface of the plug 20 opposite the recess 21. The code pin channels have been plugged with a respective stopper pin, marked 51 in FIG. 11*a*, subsequent to assembly. This can afford a manufacture/technical advantage in certain cases and also makes possible a design that includes an abutment or stop (not shown) on the code pins. When the code pins are loaded from that side at which the stopper 51 is found, said abutment will prevent the code pins from falling out when dismantling the plug 20, for instance.

The inventive plug (cylinder) is simple to manufacture: The key recess is milled out and the code pin channels and the channels/grooves for the blocking elements are then drilled or milled.

Although the inventive cylinder lock-key combination has been described with reference to preferred exemplifying embodiments, it will be understood that these embodiments can be varied within the scope of the inventive concept defined in the accompanying claims. For channels per row have been described. It will be understood that this can be varied so that one row or more than two rows are used, for example, and/or that there is used a number other than six channels per row. Similarly, a different number of code positions per code pin can be used.

Although blocking elements consisting of pins or side bars have been described, it will be understood that these two types of blocking elements can be varied in different ways. For example, one row of code pins may communicate with blocking pins, while another row communicates with a side bar.

Although the key recess as been described as being provided in the barrel surface of the cylinder plug, it will be understood that this definition also applies when, e.g., a thin sleeve is placed around the plug and rotates together therewith, thereby reducing wear between plug and cylinder housing that may otherwise occur. The sleeve, referenced 52 in FIGS. 11*a* and 11*b*, also provides the advantage of holding the code pins in place in the plug, even when said plug is removed from the cylinder housing.

What is claimed is:

1. A cylinder lock-key combination, comprising:

a cylinder housing, a key that includes a gripping portion and a key bit portion having a first side surface and a second side surface, a plug or cylinder which includes a circular-cylindrical barrel surface and which is arranged for rotation in an opening in said housing and which includes a recess for receiving said key and a plurality of code pin channels code pins movably arranged in a plurality of said plurality of code pin channels and actuated in response to movement of the key, and a blocking element arranged for movement in said plug in accordance with the position of said code pins, between a blocking position, in which rotation of the plug relative to said housing is blocked, and a release position, in which the plug can rotate relative to said housing, wherein said recess is provided in said barrel surface and includes a single bottom surface into which said code pin channels open at a distance from a side surface of said recess, a side surface of said key bit portion includes code surfaces adapted for co-action with said code pins, wherein said code surfaces are arranged at a distance from an edge of said side surface of said key bit portion, and wherein the ratio of the width (b) to the depth (d) of said recess (is greater than two.

2. The combination according to claim 1, in which the ratio of the width (b) to the depth (d) of said recess is greater than three.

3. The combination according to claim 1, in which said recess has a convex bottom surface.

4. The combination according to claim 1, in which said recess has a concave bottom surface.

5. The combination according to claim 1, in which said recess has a planar bottom surface.

6. The combination according to claim 1, in which said recess includes slots.

7. The combination according to claim 1, in which a front portion of said plug has a fully surrounding ring.

8. The combination according to claim 7, in which said ring has a sector adapted for engagement with said recess, whereby the ring rotates together with the plug.

9. The combination according to claim 7, in which the ring is comprised of a hard material.

10. The combination according to claim 1, in which said code pins are movable generally at right angles to the direction of movement of said blocking element.

11. The combination according to claim 1, in which said code pin channels are disposed in rows (A–D).

12. The combination according to claim 11, in which said code pin channels in different rows are disposed in mutually the same axial positions.

13. The combination according to claim 11, in which said code pin channels in different rows are mutually displaced axially.

14. The combination according to claim 1, in which said code pin channels are placed in different positions to the code pin channels in the remainder of the cylinder lock in the same lock system.

15. The combination according to claim 1, in which said blocking element includes blocking pins having a tip intended for engagement in an indentation provided in said opening.

16. The combination according to claim 11, in which said blocking element comprises a side bar a having an upper part intended for engagement in a longitudinally extending groove provided in said opening.

17. The combination according to claim 16, in which said side bar includes a lower part that has portions of different height depending on which of said rows (A–D) said portions shall operate against.

18. The combination according to claim 1, in which said code pins include at least one waist portion adapted to enable the blocking element to move to said release position when said code pins have been moved to correct positions by means of the key.

19. The combination according claim 1, comprising a sleeve placed around plug and rotating together therewith.

20. The combination according to claim 1, in which said blocking element comprises a side bar having an upper part intended for engagement in a longitudinally extending groove provided in said opening.

* * * * *